United States Patent [19]

Nystuen

[11] Patent Number: 4,802,347

[45] Date of Patent: Feb. 7, 1989

[54] PUMP MOTOR/BASKET BRAKE FOR AN AUTOMATIC WASHER

[75] Inventor: Arne M. Nystuen, Stevensville, Mich.

[73] Assignee: Whirlpool Corporation, Benton Harbor, Mich.

[21] Appl. No.: 137,601

[22] Filed: Dec. 24, 1987

[51] Int. Cl.[4] ..... D06F 13/02; D06F 37/40

[52] U.S. Cl. ..... 68/23.7; 188/161; 310/117

[58] Field of Search ..... 68/23.6, 23.7; 310/93, 310/116, 117, 254; 188/161, 162

[56] References Cited

U.S. PATENT DOCUMENTS

| | | | |
|---|---|---|---|
| 2,591,510 | 4/1952 | Clark | 310/78 X |
| 2,613,242 | 10/1952 | Shumaker et al. | 310/254 X |
| 2,694,781 | 11/1954 | Hinz | 310/77 |
| 3,115,218 | 12/1963 | Waldrop | 68/23.7 X |
| 3,184,933 | 5/1965 | Gaugler | 68/23.6 |
| 3,970,907 | 6/1976 | Meyers | 318/207 C |
| 4,375,587 | 3/1983 | Perl | 310/209 X |

*Primary Examiner*—Philip R. Coe

*Attorney, Agent, or Firm*—Hill, Van Santen, Steadman & Simpson

[57] ABSTRACT

An automatic washer is provided with a separate motor to drive the drain pump, the motor having a displaceable stator portion connected to the basket brake mechanism such that when the pump motor is energized the basket brake will be released. Such a construction obviates the need for a separate component such as a solenoid to deactivate the brake mechanism. The stator portion is displaceable perpendicularly to the rotor axis and can move either in a radial sliding manner or can be pivotally mounted so as to move through an arc relative to the rotor.

12 Claims, 2 Drawing Sheets

PUMP MOTOR/BASKET BRAKE FOR AN AUTOMATIC WASHER

BACKGROUND OF THE INVENTION

1. Field of the Invention

The present invention relates to automatic washers and more particularly to an improved arrangement for activating a basket brake for an automatic washer.

2. Description of the Prior Art

In automatic washers it is standard practice to apply a brake to the wash basket during certain periods of a wash cycle, such as during an agitate mode so that the basket is held stationary relative to an oscillating agitator. At other times in the wash cycle it is desirable to pemit the basket to rotate, such as during a period while wash liquid is being pumped from the basket, such as during a spin dry mode.

To operate the brake which oftentimes is in the form of a band surrounding a hub which rotates with the basket, a solenoid is used wherein the brake band is generally biased into an engaging position when the solenoid is off, so that in the event of a power outage this results in the brake being on. The solenoid overcomes the spring bias and moves the brake band into an off or release position.

A solenoid is a fairly expensive electrical component and it would be advantageous if the brake could be controlled without resort to the use of this separate component.

U.S. Pat. No. 4,375,587 discloses a motor having either an axially displaceable rotor or an axially displaceable pole piece, both of which are caused to move by magnetic attraction when the motor is energized to accuate a switch. Other patents disclosing axially displaceable rotors include U.S. Pat. Nos. 2,591,510; 3,184,933 and 2,694,781.

SUMMARY OF THE INVENTION

The present invention provides an improved motor construction which, in one embodiment of use provides a means for activating and deactivating a band brake for an automatic washer which obviates the need for a separate electrical component such as a solenoid to operate the brake.

The improved motor construction provides that a portion of the field or stator of the motor be displaceable relative to the rotor in either a sliding or pivotable manner. This portion of the stator is normally biased into the displaced position, but upon energization of the motor the attractive magnetic forces overcome the displacing bias and draw the stator into close proximity to the rotor. A linkage is provided between the displaceable stator and the brake band so that displacement of the stator toward the rotor disengages the brake.

In automatic washers it is desirable to release the basket from restraint against rotation when a pump is pumping water from the washing machine, but at all other times it is desirable to have the basket restrained against rotation. Therefore, a separate motor having a displaceable stator can be provided for the pump to discharge water from the washing machine and, when this separate motor is activated, the basket brake will be disengaged. At all other times the brake will be biased into engagement therefore preventing rotation of the basket.

It will be appreciated that the present invention of a displaceable stator has utility and applications other than use in an automatic washer although the invention has particular utility in such an arrangement.

DESCRIPTION OF THE PREFERRED EMBODIMENT

Figure 1:
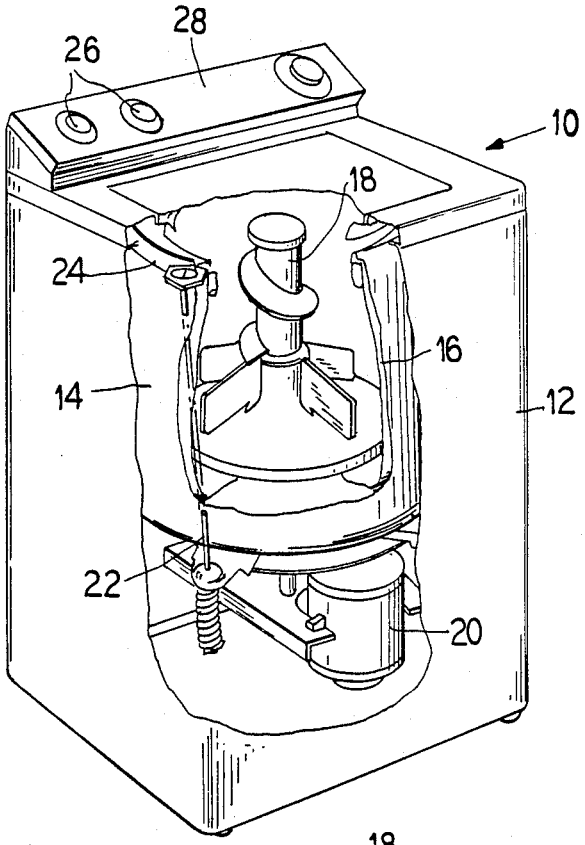
FIG. 1 is a perspective view of an automatic washer embodying the principles of the present invention.

In FIG. 1 there is illustrated an automatic washer generally at 10 embodying the principles of the present invention.

The washer has an outer cabinet 12 which encloses an imperforate wash tub 14 for receiving a supply of wash liquid. Concentrically mounted within the wash tub is a wash basket 16 for receiving a load of materials to be washed and a vertical axis agitator 18. A first motor 20 is provided which is drivingly connected to the agitator 18 to drive it in an oscillatory or rotary manner and is also selectively connectable to the basket 16 to rotatingly drive it. The assembly of tubs, agitator and motor is mounted by a suspension system 22 including springs and rods to a frame 24. A plurality of controls 26 are provided on a control console 28 for automatically operating the washer through a series of washing, rinsing and drying steps.

Figure 2:
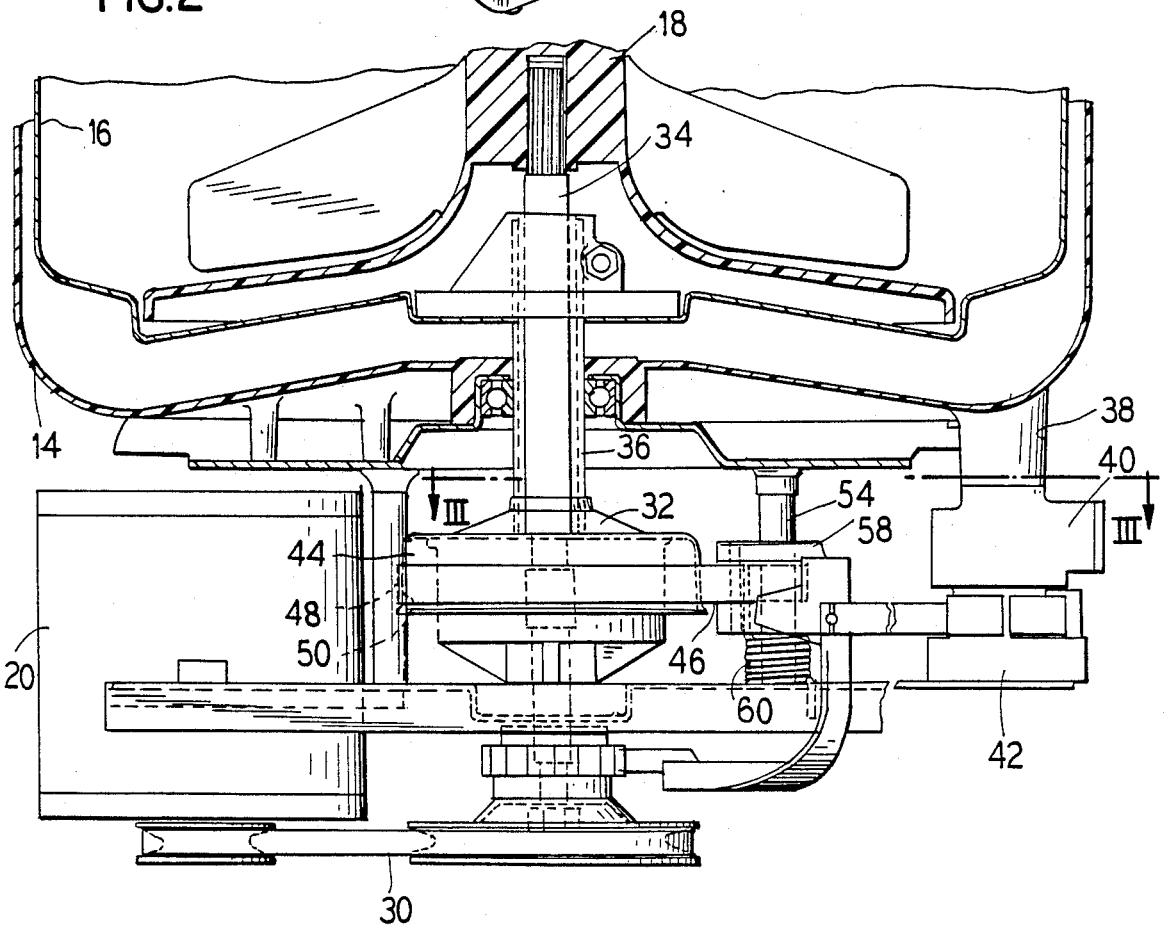
FIG. 2 is a partial side sectional view through a lower portion of an automatic washer.

The drive mechanism is shown in greater detail in FIG. 2 where it is seen that the motor 20 is connected by means of a drive belt 30 and a gear arrangement such as a planetary gear assembly 32 to a vertical shaft 34 connected to the agitator 18. The wash basket 16 is connected via a spin tube 36 to the gear arrangement 32, such as to an outer ring gear having an external hub surface 44, to provide the selective rotating drive to the basket.

The wash tub 14 has a discharge sump 38 which is connected to an input of a discharge pump 40 driven by means of a separate, second motor 42. This second motor 42 is energized at selected portions of the wash cycle when it is desired to empty wash liquid from the wash tub.

During most portions of the wash cycle it is desirable to prevent the basket 16 from rotating while in other portions of the wash cycle it is desirable to have the wash basket rotate. A basket brake 46 in the form of a band 48 surrounding the hub 44 is provided wherein the band 48 has an inner surface 50 with a high friction material so as to provide adequate griping of the hub 44 when the brake is engaged.

Figure 3:
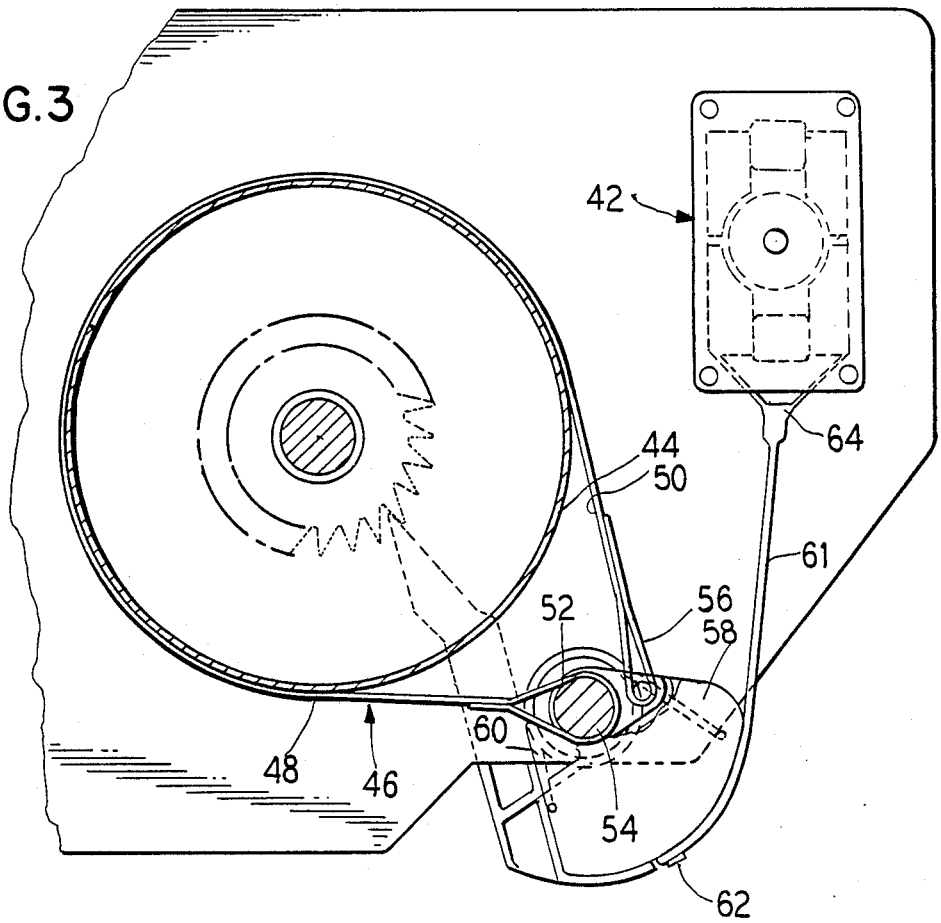
FIG. 3 is a sectional view taken generally along the line III—III of FIG. 2.

As best seen in FIG. 3, the band 48 has a first end 52 which is looped around or attached to a stationary post 54. A second end 56 is pivotably attached to a member 58 which in turn is pivotably carried on the post 54 and is biased in a clockwise direction as seen in FIG. 3 by a spring 60 carried on the post. This biasing keeps a continuous tension on the band 48 thus keeping the band 48 in close engagement with the hub 44 thereby effecting braking action between the band and the hub. In order to release the brake, the cam 58 must be rotated in a counterclockwise direction as viewed in FIG. 3. To provide such counterclockwise rotation of the cam, and thus to actuate the brake, a connecting strap 61 is secured at a first end 62 to the cam 58 and at a second end 64 to a displaceable stator portion of the second motor 42.

Figure 4:
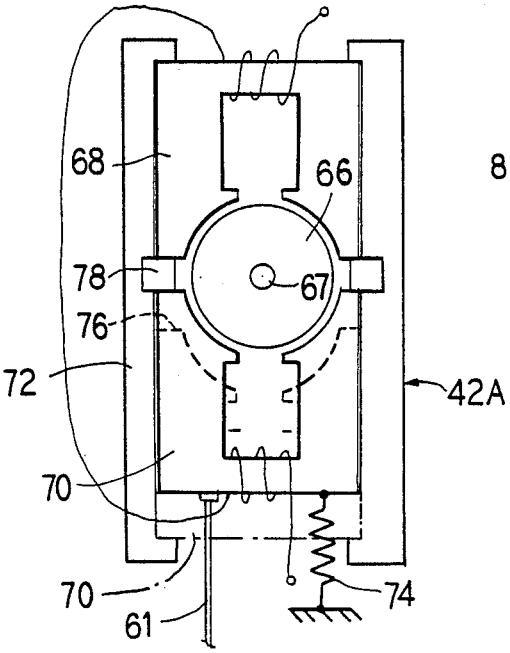
FIG. 4 is a schematic illustration of a first embodiment of the invention.

A first embodiment of such a motor is illustrated in greater detail in FIG. 4 where it is seen that a motor 42A has a central rotor 66 having a generally cylindrical shape rotatable about a central axis 67 and is closely surrounded by two separate curved arm portions 68, 70 of a stator. One of the arm portions 70 is displaceable within a housing 72 of the motor such that it can linearly slide perpendicularly away from the rotor 66 along a radial line from the axis 67. A spring 74 is schematically illustrated as applying a biasing force to the displaceable stator portion 70 to cause it to move into a displaced position shown in phantom. The strap 61 is schematically illustrated as also being connected to the displaceable stator portion 70. When the motor is placed in the arrangement as illustrated in FIG. 3, the schematically illustrated spring 74 of FIG. 4 is in fact the spring 60 which biases the cam 58 in the clockwise direction. This spring force is transmitted through the linkage means comprising the cam 58 and the strap 61.

When the motor 42A is energized, attractive magnetic forces cause the displaceable stator portion 70 to slide radially toward the rotor 66 until a forward end 76 of the stator portion abuts against a stop block 78. The attractive magnetic forces are sufficient to overcome the force of spring 60, thereby causing the cam 58 to rotate in a counterclockwise direction and thereby releasing the braking action of the brake band 48 on the hub 44.

It is desirable to drive the wash basket 16 in a rotating manner during portions of the wash cycle in which the wash water is pumped from the tub 14. Thus, when the pump 40 is driven by the second motor 42, it is desirable to release the basket brake. This will automatically occur when the second motor 42 is energized. In all other portions of the wash cycle it is desirable for the wash basket to be held stationary relative to the tub and, with the motor 42 deenergized, the spring 60 will bias the band 42 into a braking position.

Figure 5:
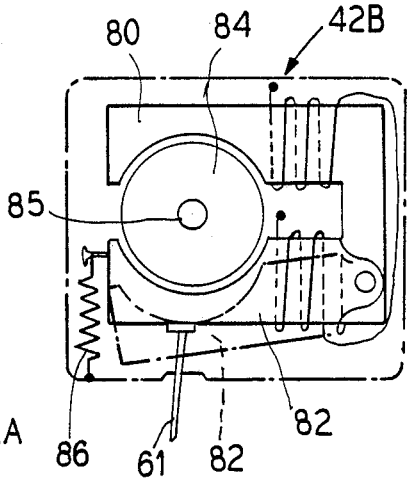
FIG. 5 is a schematic illustration of a motor incorporating a second embodiment of the invention.

An alternative embodiment of the invention is illustrated in FIG. 5 in which a motor 42B is provided with a pair of stator arm portions 80, 82 in which one of the arms 82 is pivotably displaceable away from a central rotor 84 perpendicular to an axis 85 of the rotor. Again, a spring 86 is schematically illustrated to bias the displaceable stator portion 82 to a position spaced away from the rotor 84 and the strap 61 is also illustrated as being attached to the displaceable stator portion. The spring 60 of FIG. 3 provides the biasing force illustrated schematically by the spring 86 in FIG. 5 through the linkage of the cam 58 and the strap 61.

As the motor 42B is energized, attractive magnetic forces will cause the displaceable stator 82 to pivot back through an arc to a position closely adjacent to the rotor 84 thereby pivoting the cam 58 in a counterclockwise direction to release the brake band 48.

It will be appreciated by those skilled in the art that movement of the stator can be used to activate or deactivate other mechanisms through a linkage means or an actuator in lieu of separate components to effect a cost savings.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

The embodiments of the invention is which an exclusive property or privilege is claimed are defined as follows:

1. For use in an automatic washer having a stationary tub, a selectively rotatable basket, a vertical oscillatable agitator, a first motor for selectively driving said agitator and said basket, a pump for discharging wash liquid from said tub, a second motor for selectively driving said pump, and a brake mechanism for selectively restraining said basket against rotational movement, said brake mechanism including a brake member selectively engageable with said basket to provide a desired braking action, means for activating said brake mechanism comprising:

means for biasing said brake member toward engagement with said basket to effect braking, a displaceable stator portion in said second motor, and linkage means extending between said brake member and said stator portion, whereby, energization of said second motor will result in movement of said stator portion thereby moving said brake member away from engagement with said basket to release braking.

2. Means for activating said brake mechanism according to claim 1, wherein said basket is connected to a hub member for corotation therewith and said brake member comprises a belt member selectively engageable around said hub member to provide a desired braking action.

3. Means for activating said brake mechanism according to claim 2, wherein said linkage comprises a pivotable cam to which one end of said belt is attached and a strap connected at one end to said stator portion.

4. Means for activating said brake mechanism according to claim 3, wherein said means for biasing said belt member toward said hub member comprises a spring means engageable against said cam.

5. Means for activating said brake mechanism according to claim 1, wherein said stator portion is perpendicularly displaceable relative to a rotor of said motor in a sliding manner.

6. Means for activating said brake mechansim according to claim 1, wherein said stator portion is perpendicularly displaceable relative to a rotor of said motor in a pivoting manner.

7. An automatic washer comprising:

a stationary imperforate tub for receiving a supply of wash liquid, a selectively rotatable wash basket mounted in said tub for receiving a load of materials to be washed in said wash liquid, a first motor for selectively rotating said wash basket, a brake mechanism for selectively restraining said basket against rotation, a pump for discharging wash liquid from said tub, a second motor for selectively driving said pump, said second motor having a rotatable rotor and a fixed stator wherein a portion of said stator is perpendicularly displaceable relative to said rotor upon energization of said motor, and activation means between said stator portion and said brake mechanism such that movement of said stator portion activates and deactivates said brake mechanism.

8. An automatic washer according to claim 7, wherein said basket includes a hub member rotatable therewith and said brake mechanism comprises a brake belt engageable against said hub member and a spring member normally biasing said belt into engagement with said hub.

9. An automatic washer according to claim 8, wherein said actuation means comprises a strap means between said brake belt and said displaceable stator portion to transmit a biasing force of said spring to said stator portion to displace said stator portion away from said rotor when said second motor is deenergized and to transmit a biasing force of magnetic attraction between said stator portion and said rotor to disengage said brake belt from said hub member when said second motor is energized.

10. An automatic washer according to claim 9, wherein said brake mechanism further comprises a pivotable cam to which one end of said brake belt is attached, said strap means extending between said cam and said displaceable stator.

11. An automatic washer according to claim 7, wherein said stator portion is slidable relative to said rotor and moves radially with respect thereto.

12. An automatic washer according to claim 7, wherein said stator portion is pivotally mounted relative to said rotor and moves through an arc with respect thereto.

* * * * *